US008586275B2

(12) United States Patent
Akiyama et al.

(10) Patent No.: US 8,586,275 B2
(45) Date of Patent: Nov. 19, 2013

(54) ELECTROSTATIC-LATENT-IMAGE-DEVELOPING TONER, ELECTROSTATIC LATENT IMAGE DEVELOPER, PROCESS FOR PRODUCING ELECTROSTATIC-LATENT-IMAGE-DEVELOPING TONER, IMAGE-FORMING METHOD, AND IMAGE-FORMING APPARATUS

(75) Inventors: Hitomi Akiyama, Kanagawa (JP); Junichi Tomonaga, Kanagawa (JP); Yasunobu Kashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 675 days.

(21) Appl. No.: 12/558,010

(22) Filed: Sep. 11, 2009

(65) Prior Publication Data

US 2010/0075240 A1 Mar. 25, 2010

(30) Foreign Application Priority Data

Sep. 19, 2008 (JP) ..... 2008-241385
Jun. 26, 2009 (JP) ..... 2009-152679

(51) Int. Cl.
*G03G 9/08* (2006.01)

(52) U.S. Cl.
USPC ..... 430/110.4; 430/137.14; 399/252

(58) Field of Classification Search
USPC ..... 430/110.4, 137.14; 399/252
See application file for complete search history.

(56) References Cited

U.S. PATENT DOCUMENTS

| | | | | |
|---|---|---|---|---|
| 6,132,921 | A * | 10/2000 | Ishiyama et al. | 430/109.3 |
| 7,402,370 | B2 * | 7/2008 | Kmiecik-Lawrynowicz et al. | 430/108.6 |
| 2005/0287459 | A1 | 12/2005 | Moffat et al. | |
| 2006/0210899 | A1 | 9/2006 | Nakazawa et al. | |
| 2007/0273941 | A1 | 11/2007 | Ito | |

FOREIGN PATENT DOCUMENTS

| | | | |
|---|---|---|---|
| CN | 1716111 | A | 1/2006 |
| CN | 1834794 | A | 9/2006 |
| CN | 101078896 | A | 11/2007 |
| JP | 2005-257742 | A | 9/2005 |
| JP | A-2006-1981 | | 1/2006 |
| JP | 2006-126359 | A | 5/2006 |

OTHER PUBLICATIONS

Mar. 29, 2012 Chinese Office Action issued in Chinese Patent Application No. 200910174395.6 (with translation).
Notification of Reasons for Refusal in Japanese Application No. 2009-152679 mailed Jun. 18, 2013.

* cited by examiner

*Primary Examiner* — Mark A Chapman
(74) *Attorney, Agent, or Firm* — Oliff & Berridge, PLC

(57) ABSTRACT

An electrostatic-image-developing toner includes toner particles containing a binder resin, a colorant, and a release agent, wherein the toner contains colorless binder resin particles and, of the colorless binder resin particles, particles having a volume-average particle size diameter 1.5 times as large as, or larger than that of, D50 of the toner particles are in a proportion of about 30 particles or less particles per 5,000 toner particles, with D50 being a volume-average particle size diameter of the toner particles.

6 Claims, 2 Drawing Sheets

ELECTROSTATIC-LATENT-IMAGE-DEVELOPING TONER, ELECTROSTATIC LATENT IMAGE DEVELOPER, PROCESS FOR PRODUCING ELECTROSTATIC-LATENT-IMAGE-DEVELOPING TONER, IMAGE-FORMING METHOD, AND IMAGE-FORMING APPARATUS

CROSS-REFERENCE TO RELATED APPLICATIONS

This application is based on and claims priority under 35 USC 119 from Japanese Patent Application Nos. 2008-241385 and 2009-152679 filed on Sep. 19, 2008 and Jun. 26, 2009, respectively.

BACKGROUND

1. Technical Field

The present invention relates to an electrostatic-image-developing toner, an electrostatic image developer, a process for producing an electrostatic-image-developing toner, an image-forming method, and an image-forming apparatus.

2. Related Art

Methods of visualizing image information via electrostatic latent images in the electrophotographic and other methods have been widely used in various applications. In these methods, the electrostatic latent image on the surface of a photoreceptor for electrophotography (latent image bearing body, hereinafter being referred to as "photoreceptor" in some cases) is visualized by developing the latent image with an electrostatic latent image developing toner (hereinafter also referred to merely as "toner") via a charging step, an exposing step, etc. and, further, via a transfer step, a fixing step, etc.

As a process for producing such toners, there are known a kneading-pulverizing process and an emulsion-polymerizing-aggregating process. The former kneading-pulverizing process provides toner particles having a comparatively broad particle size distribution and an irregular form, and hence the process fails to provide sufficient performance-maintaining properties.

On the other hand, the emulsion-polymerizing-aggregating process is a process wherein aggregated particles having a particle size diameter corresponding to that of toner particles are formed and then heated to fuse them to form toner particles. Further, the particle structure can be controlled more accurately by conducting free control in the toner particles from the inside layer toward the surface layer thereof.

SUMMARY

According to an aspect of the invention, there is provided an electrostatic-image-developing toner including: toner particles containing a binder resin, a colorant, and a release agent, wherein the toner contains colorless binder resin particles and, of the colorless binder resin particles, particles having a volume-average particle size diameter 1.5 times as large as, or larger than that of, D50 of the toner particles are in a proportion of about 30 particles or less particles per 5,000 toner particles, with D50 being a volume-average particle size diameter of the toner particles.

BRIEF DESCRIPTION OF THE DRAWINGS

Exemplary embodiment (s) of the present invention will be described in detail based on the following figures, wherein:

FIG. 2 is a schematic view showing constitution of one example of an image-forming apparatus to be used for the image-forming method of the invention, wherein

Figure 1:
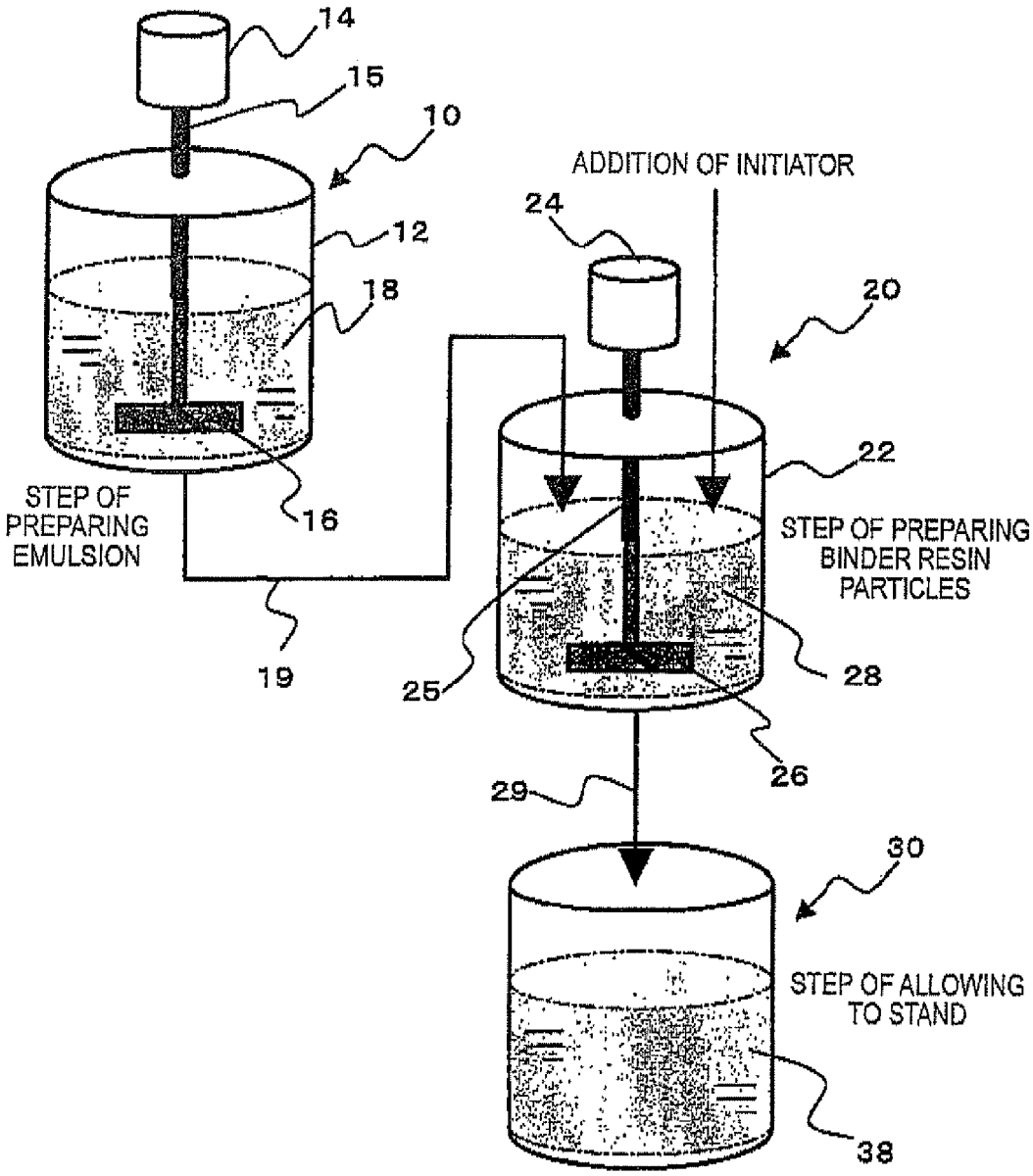
FIG. 1 is a schematic view showing constitution of one example of an apparatus for producing binder resin particles to be used for the process of producing the toner in an exemplary embodiment of the invention.

200 denotes Image-forming apparatus, 400 denotes Housing, 401*a* to 401*d* denote Electrophotographic photoreceptors, 402*a* to 402*d* denote Charging rolls, 403 denotes Exposing apparatus, 404*a* to 404*d* denote Developing devices, 405*a* to 405*d* denote Toner cartridges, 406 denotes Driving roll, 407 denotes Tension roll, 408 denotes Backup roll, 409 denotes Intermediate transfer belt, 410*a* to 410*d* denote Primary transfer rolls, 411 denotes Tray (tray for transfer-receiving materials), 412 denotes Conveying roll, 413 denotes Secondary transfer roll, 414 denotes Fixing roll, 415*a* to 415*d*, 416 denote Cleaning blades, and 500 denotes Transfer-receiving material.

DETAILED DESCRIPTION

An electrostatic-image-developing toner, electrostatic image developer, a process for producing an electrostatic-image-developing toner, an image-forming method, and an image-forming apparatus in exemplary embodiments of the present invention will be described below.

[Electrostatic-Image-Developing Toner and Process for its Production]

The electrostatic-image-developing toner (hereinafter also referred to as "toner") of the exemplary embodiment of the invention includes toner particles containing a binder resin, a colorant, and a release agent, wherein the toner contains colorless binder resin particles and, of the colorless binder resin particles, particles having a volume-average particle size diameter 1.5 times as large as, or larger than that of, D50 of the toner particles are in a proportion of 3 particles or less particles per 5,000 toner particles, or about 30 particles or less particles per 5,000 toner particles, with D50 being a volume-average particle size diameter of the toner particles.

In the case of preparing resin particles by emulsion polymerization according to the emulsion-polymerizing-aggregating process to be described hereinafter, an emulsion of an oil phase in an aqueous phase is formed upon addition of the oil phase to the aqueous phase to form micelles of various sizes. Of these micelles, solubilizing micelles are most in number and, when the polymerization initiator is added to this aqueous phase, radicals generated from the polymerization initiator reach the solublizing micelles, thus polymerization being initiated. Further, emulsion polymerization proceeds within the solublizing micelles, the polymerizable monomer is fed from emulsion oil droplets, binder resin particles grow and, thus, there can be obtained a resin particle dispersion wherein resin particles are dispersed in the aqueous phase. The emulsion oil droplets are comparatively large in size and, therefore, there can be obtained a resin particle dispersion containing dispersed therein resin particles having a uniform particle size by controlling the number of the oil droplets at a small level. However, when the dispersion state becomes unstable, the emulsion oil droplets increase in number, and the probability of radicals entering into the oil droplets increases. As a result of the increased entering, there are formed colorless binder resin particles. The colorless binder resin particles are difficult to remove from the resin particle dispersion and, in addition, they remain as such upon preparation of a toner by the emulsion-polymerizing-aggregating process and, thus, they remain in the toner as the ratio of the colorless binder resin particles to the toner particles increases, problems such as void of color are liable to arise with an image on which fixing of one toner particle is liable to exhibit great influence, such as a halftone image.

Thus, in this exemplary embodiment, stirring speed upon addition of the polymerization initiator is higher than the conventional stirring speed, whereby the polymerization initiator is widely distributed throughout the emulsion to widely deliver the polymerization initiator to the solubilizing micelles simultaneously with reduction in number of the emulsion oil droplets, thus so-called seed polymer being produced in a larger amount than in the conventional process. As a result, in comparison with the case of employing a week stirring, finally obtained resin particles have a narrower particle size distribution, which serves to suppress production of the colorless binder resin particles.

Accordingly, the existing ratio of the colorless binder resin particles which are difficulty utilized for development becomes considerably lower than with conventional toners and, even when image output is conducted for a long time in, for example, an image-forming apparatus having no trickle collection system, the amount of the colorless hinder resin particles remaining within the developing device decreases. As a result, change in the charge distribution of the toner within the developing device is suppressed. Thus, even when development of an outputted halftone image is conducted using a toner containing the colorless binder resin particles and having been used for a long time for outputting image, image defects such as void of color is suppressed.

The number of the colorless binder resin particles is 30 or less per 5,000 toner particles, or about 30 or less per 5,000 toner particles, which serves to reduce the existing ratio of the colorless binder resin particles in the toner which are difficult to use for development in comparison with conventional toners. Thus, for example, in an image-forming apparatus having no trickle collection system, change in charge distribution of the toner within the developing device is suppressed, and generation of image defects such as void of color is suppressed in the case of outputting an halftone image. More preferably, the number of the colorless binder resin particles is 10 or less per 5,000 toner particles, or about 10 or less per 5,000 toner particles. With respect to the number of the colorless binder resin particles existing in the toner, a smaller number is more preferred, with 0 being most preferred. However, even when high-speed stirring is employed for emulsion polymerization, it is rare that the polymerization initiator is distributed completely 1 uniformly to simultaneously produce the seed polymers. Hence, it is not realistic for the number to be 0.

Also, the reason why the volume-average particle size of the colorless binder resin particles is specified to be 1.5 times as large as, or more than that of, D50 of the toner particles is that those colorless binder resin particles which have a volume-average particle size which is less than 1.5 times the D50 of the toner particles are more easily used for development than colorless binder resin particles having a larger particle size and, therefore, even in an image-forming apparatus having no trickle collection system, the proportion of the colorless binder resin particles to the toner particles within a developing device does not change with lapse of time, thus the problem of void of color scarcely occurring.

Also, a shape factor SF1 of the colorless binder resin particles is preferably 120 or less, or about 120 or less. An image such as a halftone image requires uniformity upon development with a toner on a photoreceptor and upon transfer of the toner from the photoreceptor to a transfer-receiving material. Colorless binder resin particles are different from toner particles in charging properties, and hence the colorless binder resin particles are liable to disturb image due to electric repulsion for other toner particles in each step of development and transfer. Colorless binder resin particles having the SF1 value of more than 120 are more liable to have uneven charging properties and, as a result, they are considered to have the tendency of more deteriorate image quality. Additionally, the shape factor SF1 of the colorless binder resin particles is more preferably 110 or less, or about 110 or less.

A release agent may be added to the toner of this exemplary embodiment. As the release agent to be used, there can be illustrated, for example, low-molecular polyolefins such as polyethylene, polypropylene, and polybutene; silicones showing a softening temperature upon being heated; fatty acid amides such as oleic acid amide, erucic acid amide, ricinoleic acid amide, and stearic acid amide; plant waxes such as carnauba wax, rice wax, candelilla wax, Japanese wax, and jojoba oil; animal waxes such as bee wax; mineral-petroleum waxes such as montan wax, ozokerite, ceresin, paraffin wax, microcrystalline wax, and Fischer-Tropsch wax; ester waxes such as fatty acid ester, montanic acid ester, and carboxylic acid; and the modified materials thereof. These release agents may be used independently or in combination of two or more thereof.

As a preferred release agent to be used in the toner of the exemplary embodiment, those release agents which have a low polarity such as polyolefin are preferred in the point that they impart good releasing properties to a halftone image containing the colorless binder resin particles, and the weight-average molecular weight of such release agent is preferably from 500 to 5,000 and the melting temperature is preferably from 60° C. to 100° C. in view of good toner-releasing properties from paper and difficulty in appearance of luster unevenness. Since the release agent must enter between a fixing member and an image in a short time from inside the toner particles as has been described hereinbefore, the release agent is preferably of the kind illustrated hereinabove.

Further, various materials constituting the toner of the exemplary embodiment will be described in more detail below.

As the binder resin to be used, there can be illustrated homopolymers and copolymers of styrenes such as styrene and chlorostyrene; monoolefins such as ethylene, propylene, butylenes, and isoprene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Particularly representative binder resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene. Further, there can be illustrated polyester, polyurethane, epoxy resin, silicone resin, polyamide, modified rosin, and paraffin wax.

As the colorants for the toner, there can be illustrated, as representative examples, magnetic powders such as magnetite and ferrite, carbon black, aniline blue, carcoil blue, chromium yellow, ultramarine blue, Du Pont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15 and C.I. pigment blue 15:3.

In addition, various components such as internal additives, charge controlling agents, inorganic powder (inorganic particles), and organic particles. Examples of the internal additives include magnetic materials such as ferrite, magnetite, reduced iron, metals such as cobalt, manganese, and nickel, the alloys thereof, and the compounds containing these metals. Examples of the charge controlling agents include quaternary ammonium salt compounds, Nigrosine compounds, dyes including a complex of aluminum, iron or chromium, and triphenylmethane pigments. Also, inorganic powder is added for the purpose of mainly adjusting viscoelasticity of the toner, and there are illustrated all of those inorganic particles which are commonly used as external additives for the surface of the toner, such as alumina, titanic, calcium carbonate, magnesium carbonate, calcium phosphate, and cerium oxide, and are illustrated in detail hereinafter. As the aggregating agent, inorganic salts and salts of a metal having a valence of two or more can preferably be used as well as surface active agents. In particular, use of the metal salt is preferred in view of the characteristic properties such as aggregation-controlling properties and toner-charging properties.

The volume-average particle size of the toner particles in this exemplary embodiment is from 3 to 10 μm, preferably from 3 to 9 more preferably from 3 to 8 μm. Also, the number-average particle size of the toner particles in this exemplary embodiment is from 3 to 10 μm, preferably from 2 to 8 μm. In case when the particle size is too small, production properties of the particles become unstable and, in addition, charging properties of the particles become so insufficient that, in some cases, developing properties of the particles are deteriorated. On the other hand, in case when the particle size is too large, there results an image with less resolution.

The process of producing the toner particles in this exemplary embodiment preferably includes a step of emulsifying an oil phase containing a polymerizable monomer for preparing a binder resin in an aqueous phase under stirring to thereby prepare an emulsion containing the polymerizable monomer; a step of polymerizing the polymerizable monomer by stirring at high speed upon adding a polymerization initiator to the aqueous phase to which the emulsion containing the polymerizable monomer has been added to thereby prepare binder resin particles; an aggregating step of mixing a dispersion of binder resin particles wherein the thus-obtained binder resin particles of 1 μm or less, or about 1 μm or less in particle size are dispersed, a colorant dispersion wherein a colorant is dispersed, and a release agent dispersion wherein a release agent is dispersed, with each other to aggregate into particles of a toner particle size containing the binder resin and the colorant; and a fusing step of fusing by heating the thus-obtained aggregated particles to a temperature equal to or higher than the glass transition temperature of the binder resin particles to thereby form toner.

FIG. 1 shows one example of the constitution of an emulsion polymerization apparatus to be used for the process of producing the toner particles in this exemplary embodiment. The emulsion polymerization apparatus is an apparatus for producing binder rosin particles to be used for production of toner particles, and is equipped with an emulsifying apparatus 10 wherein one or more kinds of polymerizable monomers, water and, as needed, a surfactant are emulsified, a polymerizing apparatus 20 wherein an initiator is added to the emulsion prepared in an emulsifying tank 12 and containing the polymerizable monomer(s) to conduct emulsion polymerization and prepare binder resin particles and, as needed, a reservoir tank 30 for storing and standing the solution containing binder resin particles prepared in a polymerizing tank 22.

The emulsifying apparatus 10 is equipped with the emulsifying tank 12, a stirring rod 15 equipped with a stirring member 16 for stirring an emulsion 18 within the emulsifying tank 12, and a driving source 14 for rotationally driving the stirring rod 15. Also, the polymerizing apparatus 20 is equipped with a polymerizing tank 22 into which the emulsion withdrawn from the bottom of the emulsifying tank 12 of the emulsifying apparatus 10 is introduced via a pipe 19, a stirring rod 25 equipped with a stirring member 26 for stirring the emulsion-polymerized solution 28 within the polymerizing tank 22, and a driving source 24 for rotationally driving the stirring rod 25. Further, in the reservoir tank 30 is stored the binder resin particle-containing solution having been prepared in the polymerizing tank 22 and introduced into the reservoir tank 30 via a pipe 29.

In this exemplary embodiment, high-speed stirring is conducted upon adding, in the polymerizing apparatus 20, the polymerizable initiator to the polymerization monomer-containing emulsion 18 having been added to an aqueous phase to thereby polymerize the polymerizable monomer and prepare binder resin particles. The term "high-speed stirring" as used herein means a speed 1.5 times as high as, or more than that of, the stirring speed employed in a common emulsifying step of, for example, from 160 rpm to 240 rpm.

Additionally, shape of the colorless binder resin particles can usually be controlled by slowing down stirring during polymerization. Specifically, the shape factor SF1 can be controlled to 120 or less, or about 120 or less than that by slowing down the stirring speed, which has been 1.5 times as high as, or more than that of, the stirring speed before addition of the polymerization initiator, to 0.9 to 1.1 times as high as the stirring speed before addition of the polymerization.

[Electrostatic Image Developer]

The toner obtained by the process of the invention for producing the electrostatic-image-developing toner having been described above can be used as an electrostatic-image-developing toner. This developer is not particularly limited except for containing the electrostatic-image-developing toner, and can have a proper component formulation according to the purpose. Independent use of the electrostatic-image-developing toner provides a one-component electrostatic image developer, whereas combined use of the toner with a carrier provides a two-component electrostatic image developer.

The carrier is not particularly limited, and carriers which themselves are known are illustrated. For example, there may be used known carriers such as resin-coated carriers.

As specific examples of the carrier, there are illustrated the following resin-coated carriers. That is, as core particles of such carriers, there are illustrated, for example, common iron powder, ferrite, and shaped magnetite, with the average particle size thereof being from about 30 to about 200 μm. As a resin for coating such core particles, there are illustrated, for example, styrenes such as styrene, p-chlorostyrene, and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylic compounds such as dimethylaminoethyl methacrylate; vinylniriles such as acrylonitrile and methacrylonitrile; vinylpyridines such as 2-vinylpyridine and 4-vinylpyridine; vinylethers such as vinyl methyl ether and vinyl isobutyl ether; vinyl ketones such as vinyl methyl ketone, vinyl ethyl ketone, and vinyl isopropenylketone; polyolefins such as ethylene and propylene; silicones such as methyl silicone and methylphenyl silicone; copolymers of vinyl series fluorine-containing monomers such as vinylidene fluoride, tetrafluoroethylene, and hexafluoroethylene; polyesters containing bisphenol or glycol: epoxy resins; polyurethane resins; polyimide resins; cellulose resins; and polyether resins. Particularly preferred are those resins which are obtained by polymerizing a polymerizable monomer having an aromatic ring. The reason may be considered that the resins obtained by polymerizing the polymerizable monomer having an aromatic ring can readily hold static electricity in the aromatic ring moiety upon charging the toner and, therefore, even when the ratio of the colorless binder resin particles increases within the developer, they can control generation of charge in an excess amount on the colorless binder resin particles. More preferred are those resins which are obtained by polymerizing polymerizable monomers containing as a polymerizable monomer styrene whose aromatic ring moiety is liable to be in direct contact with the toner. The reason is that resins obtained by polymerizing a polymerizable monomer having the aromatic ring are preferred. These resins may be used independently or in combination of two or more thereof. The amount of the coating resin is from about 0.1 to 10 parts by mass, preferably from 0.5 to 3.0 parts by mass, based on the weight of the carrier. For producing the carriers, a heating kneader, a heating Henschel mixer, a UM mixer, or the like can be used and, depending upon the amount of the coating resin, a heating type fluidized rolling bed, a heating type kiln, or the like can be used.

Additionally, the mixing ratio of the electrostatic-image-developing toner to the carrier to be used in the electrostatic image developer is not particularly limited and can properly be selected according to the purpose.

[Image-Forming Apparatus]

Next, an image-forming apparatus of the exemplary embodiment will be described below.

Figure 2:
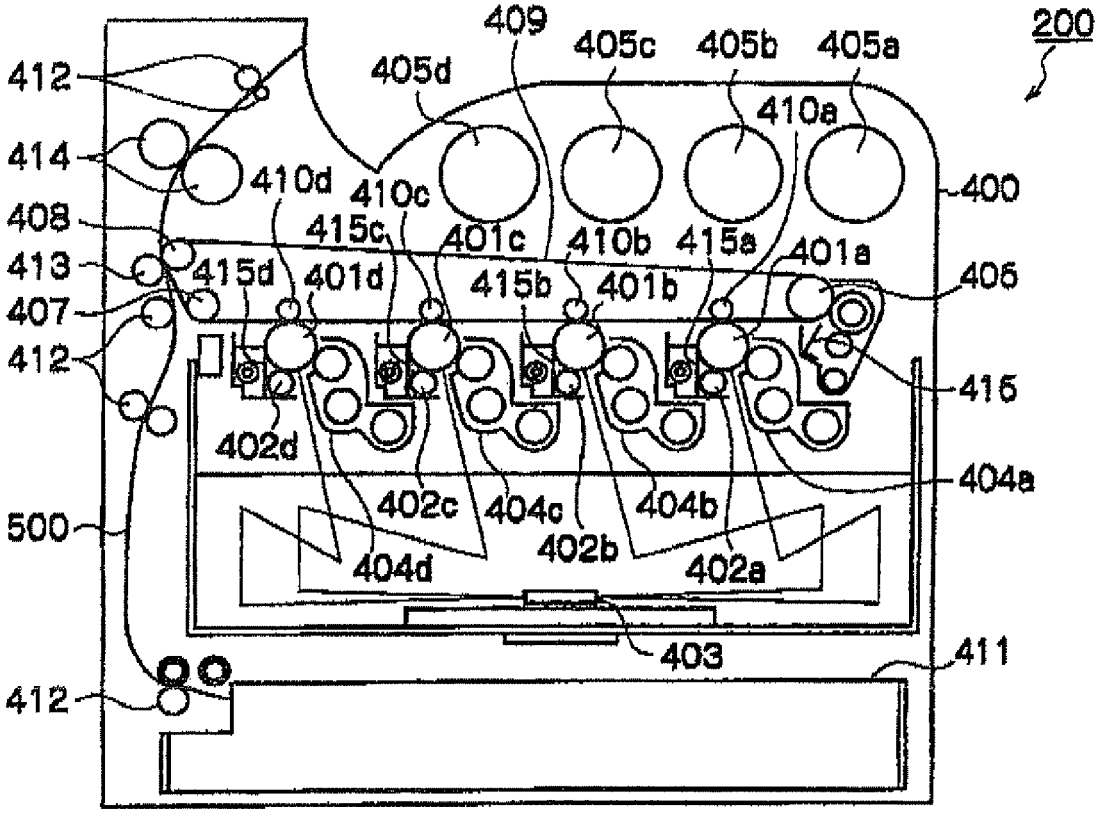

FIG. 2 is a schematic view showing an example of the constitution of the image-forming apparatus for forming an image according to the image-forming method of the exemplary embodiment. In the shown image-forming apparatus 200, four electrophotographic photoreceptors 401*a* to 401*d* are mutually juxtaposed along an immediate transfer belt 409 in a housing 400. With the electrophotographic photoreceptors 401*a* to 401*d*, for example, the electrophotographic photoreceptor 401*a* can form an image including a yellow color, the electrophotographic photoreceptor 401*b* can form an image including a magenta color, the electrophotographic photoreceptor 401*c* can form an image including a cyan color, and the electrophotographic photoreceptor 401*d* can form an image including a black color.

Each of the electrophotographic photoreceptors 401*a* to 401*d* can be rotated in a predetermined direction (counterclockwise on the paper), and charging rolls 402*a* to 402*d*, developing devices 404*a* to 404*d*, primary transfer rolls 410*a* to 410*d*, and cleaning blades 415*a* to 415*d* are disposed in the rotating direction. The developing devices 404*a* to 404*d* can be provided with, respectively, a yellow toner, a magenta toner, a cyan toner, and a black toner contained in toner cartridges 405*a* to 405*d*, respectively, with the primary transfer rolls 410*a* to 410*d* being in touch with, respectively, the electrophotographic photoreceptors 401*a* to 401*d* via the intermediate transfer belt 409.

Further, an exposing apparatus 403 is disposed within the housing 400 at a predetermined position so that light beam emitted from the exposing apparatus 403 can be irradiated onto the surface of each of the electrophotographic photoreceptors 401*a* to 401*d* after being charged. Thus, in the step of rotating the electrophotographic photoreceptors 401*a* to 401*d*, the charging step, the exposing step, the developing step, the primary transfer step, and the cleaning step are sequentially conducted, whereby toner images with individual colors are superposedly transferred onto the intermediate transfer belt 409.

Here, the charging rolls 402*a* to 402*d* function to apply, respectively, a voltage to the photoreceptors by bringing an electrically conductive member (charging roll) into contact with the surface of each electrophotographic photoreceptors 401*a* to 401*d* to thereby charge the surface of each photoreceptor to a predetermined electric potential (the charging step). Additionally, charging may alternatively be conducted according to the contact charging method using a charging brush, a charging film or a charging tube in place of the charging roll shown in this exemplary embodiment. It is also possible to conduct charging according to a non-contact method using corotron or scorotron.

As the exposing apparatus 403, an optical apparatus can be used which can imagewise expose in a desired manner the surface of each of the electrophotographic photoreceptors 401*a* to 401*d* to radiation of light emitted from a light source such as a semiconductor laser an LED (light emitting diode) or a liquid crystal shutter. Of these, an exposing apparatus capable of exposing to radiation of non-interference light can prevent production of interference fringe due to the gap between the electrically conductive substrate of each of the electrophotographic photoreceptor 401*a* to 401*d* and the light-sensitive layer.

As the developing devices 404*a* to 404*d*, a general developing device can be employed to conduct development which can perform development using the above-mentioned two-component electrostatic image developer in a contact or non-contact manner (developing step). Such developing apparatus is not particularly limited as long as it permits use of a two-component electrostatic image developer, and a proper developing apparatus can be selected from among known ones according to the purpose. In the primary transfer step, individual color toners are successively and primarily transferred from corresponding image-bearing members to the intermediate transfer belt 409 by applying a primary transfer bias of a polarity reverse to that of the toner born on the image-bearing member to the primary transfer rolls 410*a* to 410*d*.

The cleaning blades 415*a* to 415*d* are provided for removing residual toners deposited on the surface of each of the electrophotographic photoreceptors after the transfer step, and the thus-surface-cleaned electrophotographic photoreceptors are repeatedly used in the above-mentioned image-forming process. As materials for the cleaning blades, there are illustrated, for example, urethane rubber, neoprene rubber, and silicone rubber.

The intermediate transfer roll 409 is supported with a predetermined tension by a driving roll 406, a backup roll 408, and a tension roll 407, and can be rotated by rotation of these rolls without deflection. Also, a secondary transfer roll 413 is disposed so as to be in contact with the backup roll 408 via the belt 409.

The toner is secondarily transferred to the secondary transfer roll 413 from the intermediate transfer belt to the recording medium by applying a secondary transfer bias of a polarity reverse to that of the toner on the intermediate transfer member. The intermediate transfer belt 409 having been passed between the backup roll 408 and the secondary transfer roll 413 is subjected to surface cleaning by means of the cleaning blade 416 disposed in the vicinity of the driving roll 406 or an eraser (not shown), and is then repeatedly subjected to the next image-forming process. Also, a tray (for transfer-receiving material) 411 is provided within the housing 400 at a predetermined position, and a transfer-receiving material 500 such as paper within the tray 411 is conveyed between the intermediate transfer belt 409 and the secondary transfer roll 913 and between two fixing rolls 414 in contact with each other by means of conveying rolls 412, and then discharged out of the housing 400.

<Image-Forming Method>

The image-forming method in this exemplary embodiment includes at least a step of charging an image-bearing member, a step of forming a latent image on the image-bearing member, a step of developing the latent image on the latent image-bearing member by using the above-mentioned electrophotographic image developer, a primary transfer step of transferring the developed toner image onto an intermediate transfer member, a secondary transfer step of transferring the toner image having been transferred onto the intermediate transfer member, and a step of fixing the toner image by heat and pressure. The developer is a developer containing at least the electrostatic-image-developing toner of the invention. The developer may be either of one-component type and two-component type.

As the individual steps described above, those Steps may be employed which are known in the field of image-forming methods.

As the latent image-bearing member, there can be used, for example, an electrophotographic photoreceptor and a dielectric recording member. With the electrophotographic photoreceptor, the surface of the electrophotographic photoreceptor is uniformly charged by means of, for example, a corotron charger or a contact charger, followed by exposing to light to form an electrostatic latent image (a latent image-forming step). Subsequently, the surface of the photoreceptor is brought into contact with, or to the vicinity of, a developing roll having formed on the surface thereof a developer layer to thereby deposit toner particles onto the electrostatic latent image and form a toner image on the electrophotographic photoreceptor (a developing step). The thus-formed toner image is transferred onto the surface of a transfer-receiving material such as paper by utilizing a corotron charger or the like (a transfer step). Further, as needed, the toner image having been transferred onto the surface of the transfer-receiving material is heat-fixed by a fixing machine to form a final toner image.

Additionally, upon heat-fixing by means of the fixing machine, a release agent is fed to a fixing member in a common fixing machine in order to prevent offset or the like. With the fixing machine in the image-forming apparatus in accordance with this exemplary embodiment, it is not necessary to feed the release agent, and fixing can be performed in an oil-less manner.

Methods for feeding a release agent onto the surface of a roller or belt to be used as a fixing member for heat fixing are not particularly limited, and there are illustrated, for example, a pad system of using a pad impregnated with a liquid release agent, a web system, a roller system, and a non-contact shower system (spray system), with a web system and a roller system being preferred. These systems are advantageous in that the release agent can be uniformly fed and that it is easy to control the feeding amount. Additionally, in order to uniformly feed the release agent all over the fixing member by the shower system, it is necessary to specially use a blade or the like.

As the transfer-receiving member (recording member) for transferring a toner image, there are illustrated, for example, plain paper and OHP sheet to be used in electrophotographic system copiers and printers.

EXAMPLES

The invention will be described in more detail below by reference to Examples which, however, are not to be construed as limiting the invention.

First, in these Examples, individual measurements are conducted as described below.

—Method for Measuring Particle Size and Particle Size Distribution—

Particle diameter (also referred to as "particle size") and particle diameter distribution (also referred to as "particle size diameter") will be described below.

In the case where particle diameters to be measured are 2 μm or larger), Coulter Multisizer U (manufactured by Beckman Coulter, Inc.) is used as a measuring apparatus, with an electrolyte solution used being ISOTON-II (manufactured by Beckman Coulter, Inc.).

In the measuring method, 0.5 to 50 mg of a sample to be measured is added to 2 ml of a 5% aqueous solution of a surfactant as a dispersing agent, preferably sodium alkylbenzenesulfonate. The resulting solution is added to 100 ml of the electrolyte solution.

The electrolyte solution containing the suspended sample is subjected to dispersion treatment for about one minute in en ultrasonic disperser, and then the particle size distribution is measured by means of the Coulter Multisizer-II for particles from 2 to 60 μm using an aperture of 100 μm in aperture size, thus the volume average particle size distribution and the number-average particle size distribution being determined. The number of particles measured is 5,000.

Furthermore, the toner particle size distribution is determined in the following manner. Namely, the previously measured particle size distribution is divided into particle size ranges (channels), and a volume cumulative distribution curve is drawn beginning at the smaller particle sizes. On this curve, the particle size at the point where the accumulated particle volume reaches 16% is defined as D16v, and the particle size at the point where the accumulated particle volume reaches 50% is defined as D50v. Similarly, the particle size at the point where the accumulated particle volume reaches 84% is defined as D84v.

In the invention, the volume average particle size refers to D50v, and the volume average particle size index GSDv is calculated using the formula shown below.

$$GSDv=\{(D84v)/(D16v)\}^{0.5} \quad \text{Formula}$$

In the case where the particle size to be measured is less than 2 μm, measurement is conducted using a laser diffraction particle size distribution analyzer (LA-700; manufactured by Horiba, Ltd.). The measurement method involves adjusting the dispersion-state sample so that the solid fraction of the sample is about 2 g, and then adding deionized water to make the sample up to about 40 ml. This sample is then added to the cell in sufficient quantity to generate a suitable concentration, and the sample is allowed to stand for about 2 minutes until the concentration within the cell is substantially stabilized, followed by conducting the measurement. The volume average particle size for each of the obtained channels is accumulated beginning at the smaller volume average particle sizes, and the point where the accumulated value reaches 50% is defined as the volume average particle size.

Additionally, in the case of the measurement of a powder of an external additive or the like, 2 g of the sample to be measured is added to 50 ml of a 5% aqueous solution of a surfactant, preferably sodium alkylbenzenesulfonate, and the resulting mixture is dispersed for two minutes in an ultrasonic disperser (1,000 Hz), thereby yielding a sample. This sample is then subjected to measurement in the same manner as with the dispersion described above.

—Method of Measuring Toner Shape Factor SF1—

The shape factor SF1 of a toner is a shape factor SF that indicates the degree of unevenness on the surface of the toner particles, and is calculated using the formula shown below, $$SF1=(ML^2/A)\times(n/4)\times 100 \quad \text{Formula}$$

In this formula, ML represents the maximum length of a toner particle, and A represents the projected area of the toner particle. Measurement of the shape factor SF1 is conducted by first loading an optical microscope image of a toner scattered on a slide glass into an image analyzer via a video camera, subsequently calculating the SF value for at least 50 toner particles, and then determining the average value of these calculated shape factor values.

—Method of Measuring Glass Transition Temperature—

The glass transition temperature of a toner is determined according to a DSC (differential scanning calorimetry) measurement method, and is determined from the subjective maximum peak measured in accordance with ASTM D3418-8.

Measurement of the subjective maximum peak can be conducted using a DSC-7 device manufactured by Perkin Elmer Inc. In this device, temperature correction at the detection unit is conducted using the melting temperatures of indium and zinc, and correction of the heat quantity is conducted using the heat of fusion of indium. The sample is placed in an aluminum pan, and measurement is conducted at a rate of temperature increase of 10° C./min using an empty pan as a control.

—Method of Measuring Molecular Weight and Molecular Weight Distribution for Toners and Resin Particles—

Measurements of the molecular weight distribution are conducted under the following conditions. Namely, GPC is conducted using devices HLC-8120GPC and SC-8020 (manufactured by Tosoh Corporation), two columns (TSK-gel, Super HM-H; manufactured by Tosoh Corporation; 6.0 mmID×15 cm), and using THF (tetrahydrofuran) as the eluent. Testing is conducted under conditions including a sample concentration of 0.5%, a flow rate of 0.6 ml/min, a sample injection volume of 10 μl and a measurement temperature of 40° C., using an IR detector. Further, the calibration curve is prepared using 10 polystyrene TSK standard samples manufactured by Teach Corporation: A-500, F-1, F-10, F-80, F-380, A-2500, F-4, F-40, F-128, and F-700.

—Number of Colorless Binder Resin Particles—

The number is determined by photographing an observed entire toner image using LUZEX manufactured by Nireco Corporation, arbitrarily selecting about 5,000 toner particles, and conducting image analysis for the toner particles. Particles satisfying the condition that, when observed with a magnification of 800×, the color of the particles is white, and that the particle diameter of the particles is 1.5 times as much as, or more than that of, D50 of the toner particles, with D50 being the volume-average particle diameter of the toner particles.

Also, the shape factor SF1 of the particles can be determined by this method.

The invention will be described more specifically by reference to Comparative Examples and Examples in accordance with the invention. However, the invention is in no way limited by the content of the Examples presented below. In the following description, unless stated otherwise, the units "parts" are all "parts by mass".

[Production Examples of Toners and Evaluation of Developers]

<Production of Toners 1*a* to 1*d*>

—Preparation of Resin Particle Dispersion (1)—

A polymerization reaction tank is charged with 370 parts by mass of deionized water and 0.3 part by mass of a surfactant, and the temperature is raised to 75° C. under stirring to mix. Meanwhile, the components listed below are combined in an emulsification tank and mixed under stirring to thereby prepare an emulsion.

| | |
|---|---|
| Deionized water | 170 parts by mass |
| Nonionic surfactant (Nonipol 400; manufactured by Sanyo Chemical Industries, Ltd.) | 2 parts by mass |
| Anionic surfactant (Neogen SC; manufactured by Dai-ichi Kogyo Seiyaku Co., Ltd.) | 3 parts by mass |
| Styrene | 300 parts by mass |
| n-Butyl acrylate | 90 parts by mass |
| β-Carboxyethyl acrylate (hereinafter also referred to as "β-CEA") | 11 parts by mass |
| Dodecanethiol | 6 parts by mass |
| 1,10-Decanediol diacrylate | 1.5 parts by mass |

Once the temperature within the polymerization tank becomes stable, 2% of the total weight of the prepared emulsion is added to the reaction tank over a period of 10 minutes and, thereafter, 5 parts by mass of ammonium persulfate diluted 5 times with deionized water is also added to the reaction tank over a period of 10 minutes with increasing the stirring speed from 160 rpm to 240 rpm. The resulting mixture is then maintained under the condition for 20 minutes. Subsequently, the remaining emulsion is added to the reaction tank over a period of 3 hours with decreasing the stirring speed from 240 rpm to 160 rpm and, after completion of the addition, the reaction system is maintained under the same condition for further 3 hours, thereby completing the reaction. The weight-average molecular weight of the thus-obtained resin is 35,000, and the volume average particle size is 210 nm.

—Preparation of Release Agent Dispersion (1)—

| | |
|---|---|
| POLYWAX 655 (manufactured by Baker Petrolite Co., Ltd.) | 30 parts by mass |
| Cationic surfactant (Sanisol B50; manufactured by Kao Corporation) | 2 parts by mass |
| Deionized water | 70 parts by mass |

The above components are heated to 120° C., treated with a high-pressure homogenizer at 50 MPa, and then cooled rapidly, thereby yielding a release agent dispersion. The volume-average particle size of the dispersed wax is 250 nm.

Additionally, POLYWAX 655 (manufactured by Baker Petrolite Co., Ltd.) is polyethylene wax having a number-average molecular weight of 655 and a melting temperature of 99° C.

(Preparation of Pigment Dispersions)

—Preparation of Cyan Colorant Dispersion (1)—

| | |
|---|---|
| C.I. Pigment Blue 15:3 (manufactured by Dainichiseika Color & Chemicals Mfg. Co., Ltd.) | 30 parts by mass |
| Ionic surfactant (Neogen RK; manufactured by Dai-ichi Kogyo Seiyaku Co., Ltd.) | 3 parts by mass |
| Deionized water | 70 parts by mass |

The above components are mixed together and then passed 10 times through an ultrasonic disperser to obtain a pigment dispersion. The number-average particle size of the dispersed pigment is 130 nm.

—Preparation of Black Colorant Dispersion (2)—

| | |
|---|---|
| Carbon black (REGAL 330; manufactured by Cabot Corporation; primary particle size: 25 nm; BET specific surface area: 94 $m^2/g$) | 90 parts by mass |
| Anionic surfactant (Neogen SC; manufactured by Dai-ichi Kogyo Seiyaku Co., Ltd.) | 10 parts by mass |
| Deionized water | 240 parts by mass |

The above components are mixed together and then treated under the same conditions as those described for the cyan colorant dispersion to prepare a black colorant dispersion. The number-average particle size of the colorant in the black colorant dispersion is 150 nm.

—Preparation of Yellow Colorant Dispersion (3)—

| | |
|---|---|
| C.I. Pigment Yellow 74 (manufactured by Dainichiseika Color & Chemicals Mfg. Co., Ltd.) | 50 parts by mass |
| Ionic surfactant (Neogen RK; manufactured by Dai-ichi Kogyo Seiyaku Co., Ltd.) | 5 parts by mass |
| Deionized water | 195 parts by mass |

The above components are mixed together and then dispersed for 10 minutes using an Ultimaizer (manufactured by Sugino Machine Ltd.) to obtain a yellow colorant dispersion with a number-average particle size of 168 nm.

—Preparation of Magenta Colorant Dispersion (4)—

| | |
|---|---|
| C.I. Pigment Red 122 (manufactured by Clariant Ltd.) | 50 parts by mass |
| Ionic surfactant (Neogen RK; manufactured by Dai-ichi Kogyo Seiyaku Co., Ltd.) | 6 parts by mass |
| Deionized water | 200 parts by mass |

The above components are mixed together and then dispersed for 10 minutes using an Ultimaizer (manufactured by Sugino Machine Ltd.) to obtain a magenta colorant dispersion with a number-average particle size of 185 nm and a solid fraction of 23.5 parts by mass.

The following components are introduced into a reaction tank and sufficiently stirred to mix.

| | |
|---|---|
| Deionized water | 300 parts by mass |
| Resin particle dispersion (1) | 135 parts by mass |
| colorant dispersion (1) | 20 parts by mass |
| Release agent dispersion (1) | 30 parts by mass |

Then, 18 parts by mass of 1% aqueous solution of polyaluminum chloride is gradually added thereto as an aggregating agent while applying shear in Ultraturrax. Since the viscosity of the slurry increases with the addition of the aggregating agent, the rotation number of Ultraturrax is increased up to 7,000 rpm and, after completion of the addition, the slurry is subjected to dispersion treatment for five minutes.

When the temperature of this slurry is gradually increased under sufficient stirring and is maintained at 48° C. for 2 hours, the average particle size of the aggregated particles becomes 5.4 μm. At this stage, 70 parts by mass of the resin particle dispersion (1) is newly added thereto gradually over a period of 10 minutes and, after being allowed to stand for 1 hour, the average particle size of the aggregated particles becomes 5.0 μm. Subsequently, the pH of the mixture within the reaction tank is adjusted to 7.0, and the temperature thereof is slowly increased up to 95° C. and is kept at the level for 4 hours to coalesce the aggregated particles, followed by cooling to 40"C. Then, 2 parts by mass of colloidal silica (manufactured by Nippon Aerosil Co.; R972) is added thereto per 100 parts by mass of the toner, followed by stirring to mix in a Henschel mixer for 5 minutes at 22 m/s to obtain a cyan toner 1*a* having a volume-average particle size of the toner particles of 5.6 μm. In the toner 1*a*, the number of colorless binder resin particles of 8.4 μm or more in particle size per 5,000 particles of the toner particles is 16, and the average shape factor of the colorless binder resin particles is 112.

In the same manner as described above except for using, respectively, the black colorant dispersion (2), the yellow colorant dispersion (3), and the magenta colorant dispersion (4) in place of the cyan colorant dispersion (1), there are obtained a black toner 1*b*, a yellow toner 1*c*, and a magenta toner 1*d*. Also, the volume-average particle size of these toners is 5.6 μm as is the same with the cyan toner 1*a*, the number of colorless binder resin particles of 8.4 μm or more in particle size per 5,000 particles of the toner particles is 12 with the black toner 1*b*, 15 with the yellow toner 1*c*, and 17 with the magenta toner 1*d*, and the average shape factor of the colorless binder resin particles is 112 with the black toner 1*b*, 113 with the yellow toner 1*c*, and 111 with the magenta toner 1*d*.

<Production of Toner 2>

—Preparation of Resin Particle Dispersion (2)—

A resin particle dispersion (2) is prepared in the same manner as in Example 1 except that, upon adding 5 parts by mass of a polymerization initiator of ammonium persulfate diluted 5 times with deionized water to the same composition as in Example 1, the stirring speed is increased from 160 rpm to 320 rpm, that the addition of the polymerization initiator to the reaction tank is conducted over a period of 10 minutes, that, after maintaining the reaction system at the condition for 20 minutes, the stirring speed is decreased from 320 rpm to 160 rpm, that the remaining emulsion is added to the reaction tank over a period of 3 hours, and that, after completion of the addition, the reaction system is maintained at the condition for further 3 hours to complete the reaction. The weight-average molecular weight of the thus-obtained resin is 32,000, and the volume-average particle size is 190 nm.

A toner 2 is prepared in the same manner as with the toner 1*a* in Example 1 except for using the resin particle dispersion (2) in place of the resin particle dispersion (1). The particle size of the thus-obtained toner is 5.4 μm, the number of colorless binder resin particles of 8.1 μm or more in particle size per 5,000 particles of the toner particles is 8, and the average shape factor of the colorless binder resin particles is 116.

<Production of Toner 3>

—Preparation of Resin Particle Dispersion (3)—

A resin particle dispersion (3) is prepared in the same manner as in Example 1 except that, upon adding 5 parts by mass of a polymerization initiator of ammonium persulfate diluted 5 times with deionized water to the same composition as in Example 1, the stirring speed is increased from 160 rpm to 192 rpm, that the addition of the polymerization initiator to the reaction tank is conducted over a period of 10 minutes, that, after maintaining the reaction system at the condition for 20 minutes, the stirring speed is decreased from 192 rpm to 160 rpm, that the remaining emulsion is added to the reaction tank over a period of 3 hours, and that, after completion of the addition, the reaction system is maintained at the condition for further 3 hours to complete the reaction. The weight-average molecular weight of the thus-obtained resin is 37,000, and the volume-average particle size is 230 nm.

A toner 3 is prepared in the same manner as with the toner 1*a* in Example 1 except for using the resin particle dispersion (3) in place of the resin particle dispersion (1). The particle size of the thus-obtained toner is 5.8 μm, the number of colorless binder resin particles of 8.7 μm or more in particle size per 5,000 particles of the toner particles is 28, and the average shape factor of the colorless binder resin particles is 107, <Production of Toner 4>

—Preparation of Resin Particle Dispersion (4)—

A resin particle dispersion (4) is prepared in the same manner as in Example 1 except that, upon adding 5 parts by mass of a polymerization initiator of ammonium persulfate diluted 5 times with deionized water to the same composition as in Example 1, the stirring speed is kept at 160 rpm, that the addition of the polymerization initiator to the reaction tank is conducted over a period of 10 minutes, that, after maintaining the reaction system at the condition for 20 minutes, the remaining emulsion is added to the reaction tank over a period of 3 hours, and that, after completion of the addition, the reaction system is maintained at the condition for further hours to complete the reaction. The weight-average molecular weight of the thus-obtained resin is 37,000, and the volume-average particle size is 220 nm.

A toner 4 is prepared in the same manner as with the toner 1*a* in Example 1 except for using the resin particle dispersion (4) in place of the resin particle dispersion (1). The particle size of the thus-obtained toner is 5.6 μm, the number of colorless binder resin particles of 8.4 μm or more in particle size per 5,000 particles of the toner particles is 35, and the average shape factor of the colorless binder resin particles is 108.

<Production of Toner 5>

—Preparation of Resin Particle Dispersion (5)—

A resin particle dispersion (5) is prepared in the same manner as in Example 1 except that, upon adding 5 parts by mass of a polymerization initiator of ammonium persulfate diluted 5 times with deionized water to the same composition as in Example 1, the stirring speed is increased from 160 rpm to 320 rpm, that the addition of the polymerization initiator to the reaction tank is conducted over a period of 10 minutes, that, after maintaining the reaction system at the condition for 20 minutes, the stirring speed is decreased from 320 rpm to 290 rpm, that the remaining emulsion is added to the reaction tank over a period of 3 hours, and that, after completion of the addition, the reaction system is maintained at the condition for further 3 hours to complete the reaction. The weight-average molecular weight of the thus-obtained resin is 31,000, and the volume-average particle size is 170 nm.

A toner 5 is prepared in the same manner as with the toner 1*a* in Example 1 except for using the resin particle dispersion (5) in place of the resin particle dispersion (1). The particle size of the thus-obtained toner is 5.8 μm, the number of colorless binder resin particles of 8.7 μm or more in particle size per 5,000 particles of the toner particles is 19, and the average shape factor of the colorless binder resin particles is 119, <Production of Toner 6>

—Preparation of Resin Particle Dispersion (6)—

A resin particle dispersion (6) is prepared in the same manner as in Example 1 except that, upon adding 5 parts by mass of a polymerization initiator of ammonium persulfate diluted 5 times with deionized water to the same composition as in Example 1, the stirring speed is increased from 160 rpm to 320 rpm, that the addition of the polymerization initiator to the reaction tank is conducted over a period of 10 minutes, that, after maintaining the reaction system at the condition for 20 minutes, the stirring speed is decreased from 320 rpm to 300 rpm, that the remaining emulsion is added to the reaction tank over a period of 3 hours, and that, after completion of the addition, the reaction system is maintained at the condition for further 3 hours to complete the reaction. The weight-average molecular weight of the thus-obtained resin is 29,000, and the volume-average particle size is 160 nm.

A toner 6 is prepared in the same manner as with the toner 1*a* in Example 1 except for using the resin particle dispersion (6) in place of the resin particle dispersion (1). The particle size of the thus-obtained toner is 5.6 μm, the number of colorless binder resin particles of 8.4 μm or more in particle size per 5,000 particles of the toner particles is 20, and the average shape factor of the colorless binder resin particles is 122, <Production of Toner 7>

—Preparation of Release Agent Dispersion (2)—

| | |
|---|---|
| Stearyl stearate (manufactured by Nippon Nyukazai Co., Ltd.; Emalex CC-18) | 30 parts by mass |
| Cationic surfactant (Sanizol B50; manufactured by Kao Corporation) | 2 parts by mass |
| Deionized water | 70 parts by mass |

The above components are heated to 120° C. and are subjected to a high-pressure homogenizer at 50 MPa, followed by rapid cooling to obtain a release agent dispersion (2). The volume-average particle size of the dispersed wax is 200 nm.

A toner 7 is prepared in the same manner as with the toner 1*a* in Example 1 except for using the release agent dispersion (2) in place of the release agent dispersion (1). The particle size of the thus-obtained toner is 5.6 μm, the number of colorless binder resin particles of 8.4 μm or more in particle size per 5,000 particles of the toner particles is 15, and the average shape factor of the colorless binder resin particles is 113.

—Preparation of Developers 1*a* to 7—

Electrostatic image developers 1*a* to 7 are obtained by using the toners 1*a* to 7 and mixing 7 parts by mass of the individual toners with 93 parts by mass of ferrite carrier of 50 μm in volume-average particle size coated with 1% by mass of styrene-methyl methacrylate copolymer (manufactured by Mitsubishi Rayon Co., Ltd.; copolymerization ratio: 90:10; Mw: 86000) under sufficient stirring.

—Preparation of Developer 8—

Electrostatic image developer 8 is obtained by using the toners 1*a* and mixing 7 parts by mass of this toner with 93 parts by mass of ferrite carrier of 50 μm in volume-average particle size coated with 1% by mass of polymethyl methacrylate (manufactured by Soken Chemical & Engineering Co., Ltd.; Mw: 80000) under sufficient stirring.

[Evaluation Method]

—Evaluation by Using a Developing Machine—

Each of the electrostatic image developers 1*a* to 8 a is charged in a developing device, each of the toners 1*a* to 8 is charged in a cartridge, and image is outputted using a modified developing machine made by modifying DocuCentre Color 400 (manufactured by Fuji Xerox Co., Ltd. (modified to omit the trickle collection system) and shown in FIG. 2. 100 solid images (3 g/m$^2$) are outputted at a high temperature and a high humidity (in an environment of 28° C. and 85% RH), and then 1,000 sheets of an original (The Imaging Society of Japan No. 4, 1986) are continuously outputted. Presence or absence of void of color in the portion of the image having the lowest image density is visually checked every 10 outputted sheets.

The evaluation standard is such that absence of void of color till output of 500 sheets is acceptable. A sample permitting output of more sheets before generation of void of color is evaluated to be better. The number of outputted sheets before generation of void of color is preferably 700 or more. Additionally, a sample permitting output of 1,000 sheets before generation of void of color is evaluated as ">1000", further outputting not being conducted.

Results of these are shown in Table 1.

TABLE 1

| | | Toner | Particles having a particle diameter 1.5 times as large as, or larger than, D50 | | Number of sheets till void |
|---|---|---|---|---|---|
| | | particle diameter D50 (μm) | Number of particles | SF1 | of color generates in halftone |
| Example 1a | Developer 1a | 5.6 | 16 | 112 | 970 |
| Example 1b | Developer 1b | 5.6 | 12 | 112 | 990 |
| Example 1c | Developer 1c | 5.6 | 15 | 113 | 970 |
| Example 1d | Developer 1d | 5.6 | 17 | 111 | 960 |
| Example 2 | Developer 2 | 5.4 | 8 | 116 | >1000 |
| Example 3 | Developer 3 | 5.8 | 28 | 107 | 530 |
| Example 4 | Developer 5 | 5.8 | 19 | 119 | 730 |
| Example 5 | Developer 6 | 5.6 | 20 | 122 | 720 |
| Example 6 | Developer 7 | 5.6 | 15 | 113 | 920 |
| Example 7 | Developer 8 | 5.6 | 16 | 112 | 850 |
| Comparative Example 1 | Developer 4 | 5.6 | 35 | 108 | 460 |

It is seen from the results of Table 1 that, with respect to void of color in a halftone image, samples within the scope of the invention are acceptable whereas, when the number of the resin particles exceeds 30 per 5,000 toner particles, generation of void of color becomes serious as is shown in Comparative Example 1.

INDUSTRIAL APPLICABILITY

As examples of application of the present invention, there are application to image-forming apparatuses such as copiers and printers using an, electrophotographic system.

What is claimed is:

1. An electrostatic-image-developing toner comprising:

toner particles containing a binder resin, a colorant, and a release agent, wherein the toner contains colorless binder resin particles and, of the colorless binder resin particles, particles having a volume-average particle size diameter 1.5 times as large as, or larger than that of, D50 of the toner particles are in a proportion of about 30 particles or less particles per 5,000 toner particles, with D50 being a volume-average particle size diameter of the toner particles.

2. The electrostatic-image-developing toner according to claim 1, wherein the colorless binder resin particles have a shape factor SF1 of about 120 or less.

3. An electrostatic image developer comprising the toner according to claim 1 and a carrier.

4. An image-forming apparatus comprising:

a latent image-forming unit that forms a latent image on a latent image carrier, a developing unit that develops the latent image by using an electrostatic-image-developing toner, a transfer unit that transfers the developed toner image onto a transfer-receiving material, and a fixing unit that fixes the toner on the transfer-receiving material, wherein the electrostatic-image-developing toner is the electrostatic-image-developing toner according to claim 3.

5. The electrostatic-image-developing toner according to claim 1, wherein the toner is produced according to a process comprising:

emulsifying an oil phase containing a polymerizable monomer for preparing the binder resin in an aqueous phase under stirring to thereby prepare an emulsion containing the polymerizable monomer;

polymerizing the polymerizable monomer by stirring at high speed upon adding a polymerization initiator to the aqueous phase to which the emulsion containing the polymerizable monomer has been added to thereby prepare binder resin particles;

mixing a dispersion of binder resin particles wherein the thus-obtained binder resin particles of about 1 μm or less in particle size are dispersed, a colorant dispersion wherein the colorant is dispersed, and a release agent dispersion wherein the release agent is dispersed, to aggregate into particles of a toner particle size containing the binder resin and the colorant; and fusing by heating the thus-obtained aggregated particles to a temperature equal to or higher than the glass transition temperature of the binder resin particles to thereby form toner particles.

6. An image-forming method comprising:

charging a photoreceptor;

exposing the charged photoreceptor to form a latent image on the photoreceptor;

developing the latent image to form a developed image;

transferring the developed image onto a transfer-receiving material; and heat-fixing the toner on a fixing substrate;

wherein the toner is the electrostatic-image-developing toner according to claim 1.

* * * * *